US008685216B2

(12) United States Patent
De Bruyker et al.

(10) Patent No.: US 8,685,216 B2
(45) Date of Patent: Apr. 1, 2014

(54) APPARATUS AND METHOD FOR IMPROVED ELECTROSTATIC DROP MERGING AND MIXING

(75) Inventors: Dirk De Bruyker, Palo Alto, CA (US); Michael I. Recht, Mountain View, CA (US); Jürgen H. Daniel, Mountain View, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 1776 days.

(21) Appl. No.: 11/018,757

(22) Filed: Dec. 21, 2004

(65) Prior Publication Data

US 2006/0132542 A1 Jun. 22, 2006

(51) Int. Cl.
*B03C 5/02* (2006.01)

(52) U.S. Cl.
USPC ..... 204/547

(58) Field of Classification Search
USPC ..... 347/48; 204/547
See application file for complete search history.

(56) References Cited

U.S. PATENT DOCUMENTS 6,565,727 B1 * 5/2003 Shenderov ..... 204/600
2003/0183525 A1 * 10/2003 Elrod et al. ..... 204/547
2003/0186453 A1 * 10/2003 Bell et al. ..... 436/147
2003/0186454 A1 10/2003 Bruce et al.
2003/0186455 A1 10/2003 Bruce et al.

FOREIGN PATENT DOCUMENTS

WO WO 99/54730 10/1999

OTHER PUBLICATIONS

Washizu, Masao, *Electrostatic Actuation of Liquid Droplets for Microreactor Applications*; IEEE Transactions on Industry Applications, vol. 34, No. 4, Jul./Aug. 1998; pp. 732-737.
Duke University, Durham NC, *Digital Microfluidics*, http://www.ee.duke.edu/Research/microfluidics/, Dec. 11, 2004; pp. 1-4.

* cited by examiner

*Primary Examiner* — Jennifer Michener
*Assistant Examiner* — Dustin Q Dam
(74) *Attorney, Agent, or Firm* — Fay Sharpe LLP

(57) ABSTRACT

An apparatus for merging and mixing two droplets using electrostatic forces includes a substrate on which are disposed a first originating electrode, a center electrode, and a second originating electrode. The electrodes are disposed such that a first gap is formed between the first originating electrode and the center electrode and a second gap is formed between the second originating electrode and the center electrode. A dielectric material surrounds the electrodes on the substrate. A first droplet is deposited asymmetrically across the first gap, and a second droplet is deposited asymmetrically across the second gap. Voltage potentials are placed across the first gap and second gap, respectively, whereby each droplet is moved toward the other such that they collide together, causing the droplets to merge and mix, and causing oscillations within the collided droplet.

23 Claims, 10 Drawing Sheets

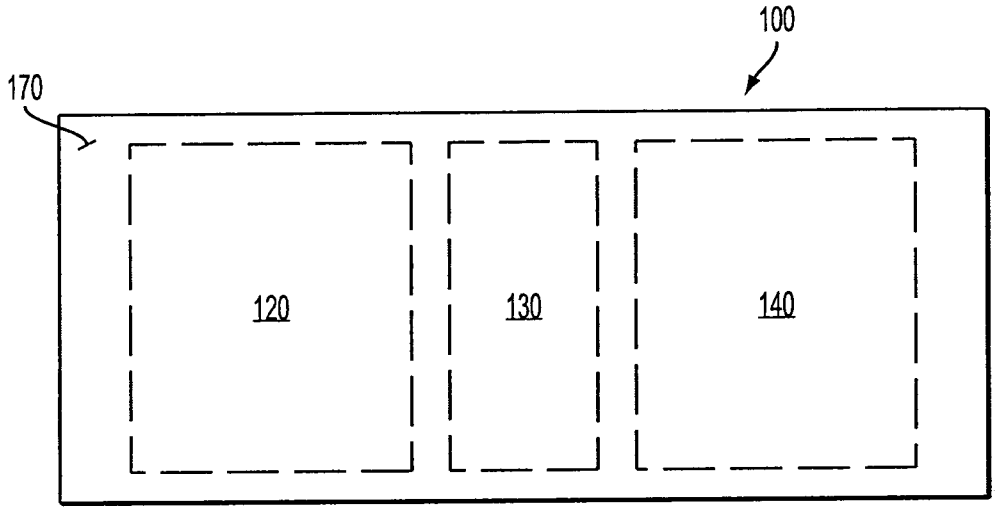
FIG. 1A
FIG. 1B
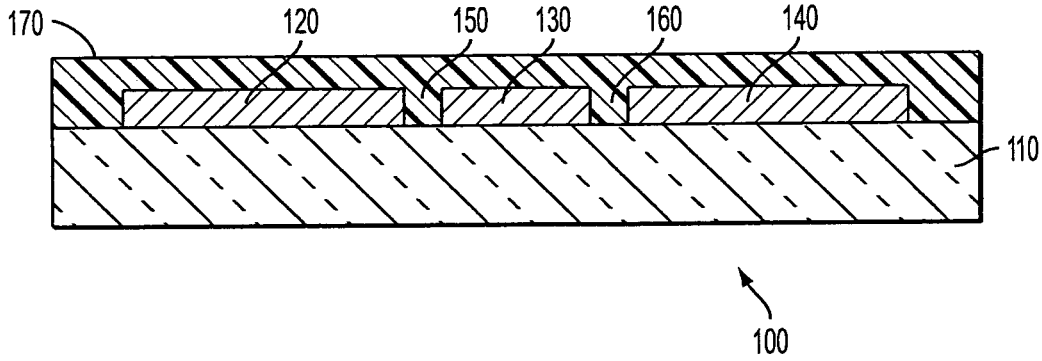

APPARATUS AND METHOD FOR IMPROVED ELECTROSTATIC DROP MERGING AND MIXING

STATEMENT REGARDING FEDERALLY SPONSORED RESEARCH OR DEVELOPMENT

This invention was made with United States Government support under HHSN 26600400058C/N01-AI-40058 awarded by NIH. The United States Government has certain rights in this invention.

CROSS REFERENCE TO RELATED APPLICATIONS

The following co-pending application, U.S. application Ser. No. 10/115,336, to Elrod et al., filed Apr. 1, 2002, titled "Apparatus and Method for Using Electrostatic Force to Cause Fluid Movement", is assigned to the same assignee of the present application. The entire disclosure of this co-pending application is herein incorporated by reference in its entirety.

BACKGROUND

The present exemplary embodiment relates to miniaturized genetic, biochemical, and chemical processes related to analysis, synthesis, and purification procedures. More specifically, the present exemplary embodiment provides an apparatus and method for improved electrostatic merging and mixing of liquid droplets in which two such liquid droplets are moved towards each other. It finds particular application in conjunction with combinatorial chemistry and nanocalorimetry, and will be described with particular reference thereto. However, it is to be appreciated that the present exemplary embodiment is also amenable to other like applications.

Existing electrostatic drop merger concepts are described in U.S. application Ser. No. 10/115,336, titled "Apparatus and Method for Using Electrostatic Force to Cause Fluid Movement". Those designs, i.e. the single capacitor design, consist of two electrodes laid out on a single substrate. The substrate and the electrodes are covered with a dielectric substance which insulates the electrodes. The electrodes are arranged in a straight edge pattern as well as a triangle or chevron pattern, spaced apart, so that a gap is formed between the electrodes. A first droplet is deposited in an asymmetrical pattern across the gap between the electrodes such that a larger volume of the droplet rests on one of the electrodes. Another droplet is deposited in close proximity to the first droplet, but on the opposite side of the gap. When a voltage is applied across the electrodes, the first droplet moves towards a centering position across the gap, thus in an equilibrium position between the two electrodes, where it touches the second, stationary, droplet and the droplets merge together.

When two droplets of equivalent size are brought together by moving one droplet into another stationary droplet, the droplets coalesce into a single droplet. The two droplets touch each other such that one side of the combined droplet has the liquid from the first droplet and the other side of the combined droplet has the liquid from the second droplet. Mixing occurs primarily due to diffusion between the two liquids at the boundary between them.

Using the existing electrostatic drop merger designs of U.S. application Ser. No. 10/115,336, mixing time may be decreased to some extent by using droplets of different sizes. If the first droplet is smaller than the other stationary droplet, and the droplets are brought together, the momentum of the smaller droplet will cause a swirling motion in the combined droplet. This swirling motion both increases the internal area over which the diffusion occurs and, depending on relative speed, may create a shearing motion inside the combined droplet, a motion which may create internal weak vortices (packets of rotating fluid) which further enhance mixing rates. Additionally, the smaller droplet may be moved forcibly into the larger, stationary, droplet. However, as the smaller droplet's diameter (and hence its mass) decreases, the momentum (or kinetic energy) of the smaller droplet decreases as well, thus decreasing its ability to enhance mixing.

Another area of study directed to the movement of fluids is being undertaken at Duke University, Durham, N.C., under the paradigm of digital microfluidics, which is based upon micromanipulation of discrete droplets. Microfluidic processing is performed on unit-sized packets of fluid which are transported, stored, mixed, reacted or analyzed in a discrete manner using a standard set of basic construction.

Research has focused on the use of electrowetting arrays to demonstrate the digital microfluidic concept. Electrowetting is essentially the phenomenon whereby an electric field can modify the wetting behavior of a droplet in contact with an insulated electrode. If an electric field is applied non-uniformly, then a surface energy gradient is created which can be used to manipulate a droplet sandwiched between two plates.

BRIEF DESCRIPTION

In accordance with one aspect of the present exemplary embodiment, an apparatus for merging and mixing two droplets using electrostatic forces is disclosed. The apparatus includes a substrate on which are disposed a first originating electrode, a center electrode, and a second originating electrode. The electrodes are disposed such that a first gap is formed between the first originating electrode and the center electrode and a second gap is formed between the second originating electrode and the center electrode. A dielectric material covers the electrodes on the substrate.

In another aspect of the present exemplary embodiment, a method for merging and mixing two droplets is disclosed. The droplets are placed on a substrate on which a first originating electrode, a center electrode, and a second originating electrode are disposed, such that a first gap is formed between the first originating electrode and the center electrode and a second gap is formed between the second originating electrode and the center electrode. A dielectric material surrounds the electrodes on the substrate. A first droplet is deposited asymmetrically across the first gap, and a second droplet is deposited asymmetrically across the second gap. Voltage potentials are placed across the first gap and second gap, respectively, whereby each droplet is moved toward the other such that they collide together, causing the droplets to merge and mix, and causing oscillations within the collided droplet.

In another aspect of the present exemplary embodiment, a method for merging and mixing two droplets is disclosed. The droplets are placed on a substrate on which a first electrode and a second electrode are disposed, such that a gap is created between the two electrodes. A dielectric material surrounds the electrodes on the substrate. A first droplet is deposited on asymmetrically across the gap, and a second droplet is disposed on the second electrode. A voltage potential is placed across the gap whereby the first droplet moves toward and collides with the second droplet, causing the droplets to merge and mix, and causing oscillations within the collided droplet.

In accord with another aspect of the present exemplary embodiment, an apparatus for merging and mixing two droplets is provided in a design with an electrode gap parallel to the direction of motion of the drops.

BRIEF DESCRIPTION OF THE DRAWINGS

FIGS. 1A and 1B illustrate a cross-section and plan view of the dual drop merger structure according to one exemplary embodiment of the present disclosure;

DETAILED DESCRIPTION

Figure 2:
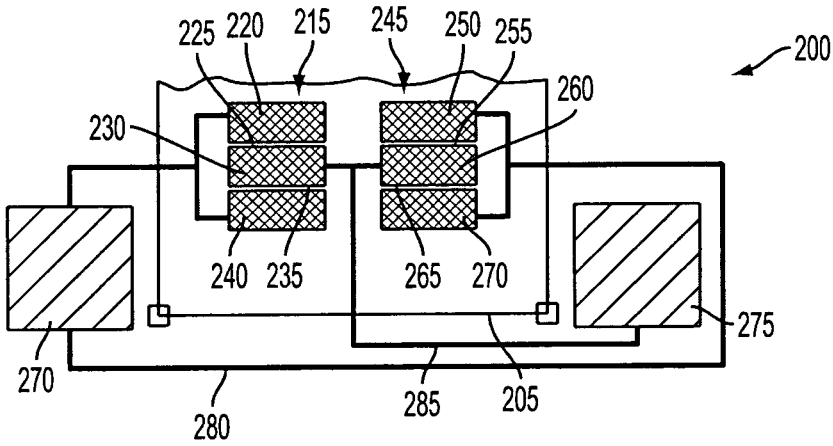
FIG. 2 illustrates the dual mode electrode layout of the dual drop merger structure depicted in FIGS. 1A and 1B according to one exemplary embodiment of the present disclosure.

As noted in U.S. application Ser. No. 10/115,336, the results obtained by a drop-merging action in a device described therein are very sensitive to the positioning of the drops, and in particular to the separation (i.e., gap) between the drops. If the gap is too large, the drops will, in fact, not merge. The present application which describes a "dual merger" concept intends to bring both drops in motion at the same time, thereby improving the overall yield of merged drops by providing more tolerance for the positioning of the drops, since each drop now only needs to travel half the separation distance to successfully merge.

Additionally, previously existing single capacitor electrostatic drop merger designs cause mixing within the droplet to occur primarily through diffusion, which is a relatively slow process. The following concepts teach a manner in which to increase the quality of mixing while at the same time keeping the mixing time to a minimum. This mixing is especially useful for assay screening applications, where multiple samples are screened at the same time using 96, 384, or 1536-well microtitre plates. Moreover, in some situations it is beneficial to use droplets of substantially similar size in order to improve throughput through the assay screening process.

With reference to FIGS. 1A and 1B, a cross-section and plan view of the dual drop merger structure is shown according to one exemplary embodiment of the present disclosure. This exemplary embodiment enables movement of drops of sample without introducing appreciable heat and also facilitates mixing of a plurality of sample types. The dual capacitor drop merger structure 100 is comprised of a substrate 110 on which resides a first originating electrode 120, a center electrode 130, and a second originating electrode 140. The first originating electrode 120 and the second originating electrode 140 are deposited on either side, and separated from, the center electrode 130, such that a first gap 150 and a second gap 160 are formed between the first originating electrode 120 and the center electrode 130 and between the second originating electrode 140 and the center electrode 130, respectively. Dielectric layer 170 is deposited adjacent to substrate 110 such that the dielectric layer 170 covers the three electrodes 120, 130, 140.

Substrate 110 refers to a material having a rigid or semi-rigid or flexible surface. In many of the embodiments, the surface of the substrate 110 will be substantially flat, although in some embodiments it may be desirable to physically separate synthesis regions for different samples with, for example, wells, raised regions, etched trenches, or the like. In some embodiments, the substrate 110 itself may contain wells, trenches, flow through regions, porous solid regions, etc., which form all or part of the synthesis region. Substrate 110 may be fabricated from various materials known in the art, for example, glass, plastic, or resin.

Electrodes 120, 130, and 140 may be thin metal films patterned using any thin film deposition process known in the art. The first originating electrode 120 and the second originating electrode 140 may range in size from approximately 10 micrometers to 5 mm on each side. The center electrode 130 may range in width from about 400 micrometers to about 600 micrometers. The first gap 150 and second gap 160 may range in size from about 1 micrometer to about 500 micrometers. It is to be understood these values are for a particular device, and other values may be appropriate, depending on the implementation.

The dielectric layer 170 covers the electrodes 120, 130 and 140 with insulating material and may range in thickness from about 0.1 micrometers to 100 micrometers. Examples of suitable materials for the dielectric layer 170 include silicon oxide, silicon nitride, silicon oxynitride, Tantalum Oxide or polymers such as Parylene, Dupont Teflon AF, 3M Fluorad, 3M EGC 1700, other fluoropolymers, polysiloxanes, diamond-like carbon or other spin-coated, spray-coated, dip coated, or vapor deposited polymers. In embodiments with aqueous based droplets, the dielectric layer 170 is preferably highly hydrophobic. In embodiments with oil based droplets, the dielectric layer 170 is preferably highly oleophobic in order to enhance the motion of the droplets. As an example, a hydrophobic dielectric may be made of Parylene. As an alternative to a hydrophobic or oleophobic dielectric layer, a hydrophobic or oleophobic surface coating may be used on top of the dielectric layer 170. Suitable hydrophobic materials typically include Fluorocarbons such as Dupont Teflon AF, 3M Fluorad, 3M EGC 1700, other fluoropolymers, polysiloxanes, diamond-like carbon or vapor or plasma deposited fluorocarbons.

Turning to FIG. 2, illustrated is a more detailed view of one embodiment of a dual-drop merger structure according to the present exemplary embodiments. Shown is the structure typically used in a nanocalorimeter application. This exemplary embodiment of the dual drop merger design is comprised of a substrate 200 which includes a thermal isolation layer 205. Within the thermal isolation layer 205 are a measurement region 215 and a reference region 245. The measurement region 215 contains a first originating electrode 220, a center electrode 230, and a second originating electrode 240. The first originating electrode 220 and the second originating electrode 240 are deposited on either side, and separated from, the center electrode 230, such that a first gap 225 is formed between the first originating electrode 220 and the center electrode 230, and a second gap 235 is formed between the second originating electrode 240 and the center electrode 230. Similarly, the reference region 245 contains another set of electrodes, a first originating electrode 250, a center electrode 260, and a second originating electrode 270. The first originating electrode 250 and the second originating electrode 270 are deposited on either side, and separated from, the center electrode 260, such that a first gap 255 is formed between the first originating electrode 250 and the center electrode 260, and a second gap 265 is formed between the second originating electrode 270 and the center electrode 260. It should be noted that the measurement region 215 and the reference region 245 are comprised of the same structural elements and therefore may be interchanged. That is, either set of electrodes may be used for the measurement or the reference. Also on the substrate 200 are a first voltage potential electrode 275 and a second voltage potential electrode 270. The first voltage potential electrode 275 is connected to the center electrodes 230 & 260 using runners 285. The second voltage potential electrode 270 is connected to the first originating electrodes 220 & 250 and to the second originating electrodes 240 & 270 via runners 280.

Within the measurement region 215, a first droplet is placed asymmetrically across the first gap 225 such that a larger percentage of the volume of the first droplet is on the first originating electrode 220. A second droplet is placed asymmetrically across the second gap 235 such that a larger percentage of the volume of the second droplet is on the second originating electrode 240. Concurrently with the placement of the first set of droplets, a first droplet is placed within the reference region 245 asymmetrically across the first gap 255 such that a larger percentage of the volume of the first droplet is on the first originating electrode 250. A second droplet is placed asymmetrically across the second gap 265 such that a larger percentage of the volume of the second droplet is on the second originating electrode 270. A voltage potential is applied across the first voltage potential electrode 275 and the second voltage potential electrodes 270, thereby supplying a voltage potential via runners 285 & 280 across the first gaps 225 & 255 and the second gaps 235 and 265, such that the first droplets move toward the second droplets and the second droplets move toward the first droplets whereby the droplets collide, merge, and mix together. Thermistors (not shown) in the measurement region 215 and reference region 245 thereafter measure the measurement temperature and the reference temperature, respectively, of the collided droplets.

Figure 3A:
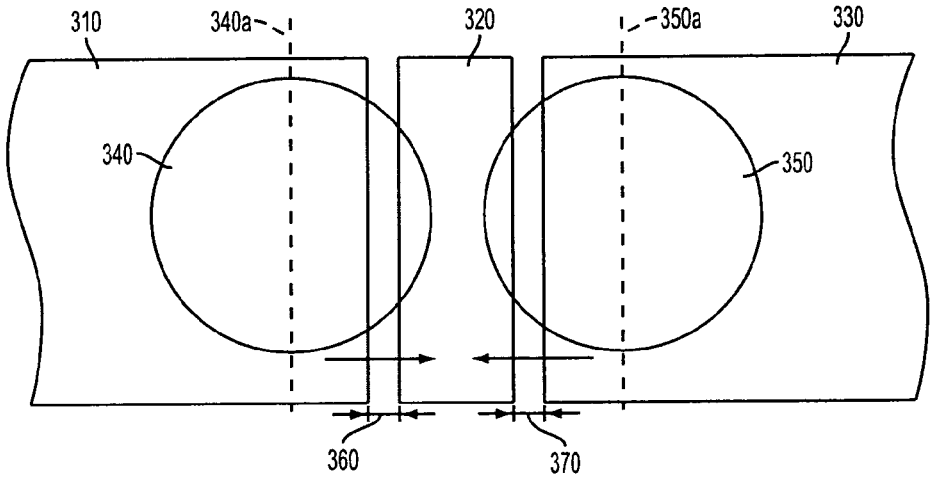
FIGS. 3A-3C illustrate dual drop movement using the dual drop merger structure of FIGS. 1A and 1B and the electrode layout of FIG. 2 according to one exemplary embodiment of the present disclosure.

With reference to FIG. 3A, a first droplet 340, with a centerline 340*a*, is deposited asymmetrically across the first gap 360 such that the larger volume of the first droplet 340 rests on top of the first originating electrode 310. The second droplet 350, with a centerline 350*a*, is deposited asymmetrically across the second gap 370 such that the larger volume of the second droplet 350 rests on top of the second originating electrode 330. A voltage potential is placed across the first gap 360 and across the second gap 370. Alternatively, the voltage potential placed across the first gap 360 may be different than the voltage potential placed across the second gap 370. Different voltage potentials may be used, for example, when the first droplet 340 and the second droplet 350 are comprised of different substances. Alternatively, the voltage potential may be in the form of pulses.

Figure 3B:
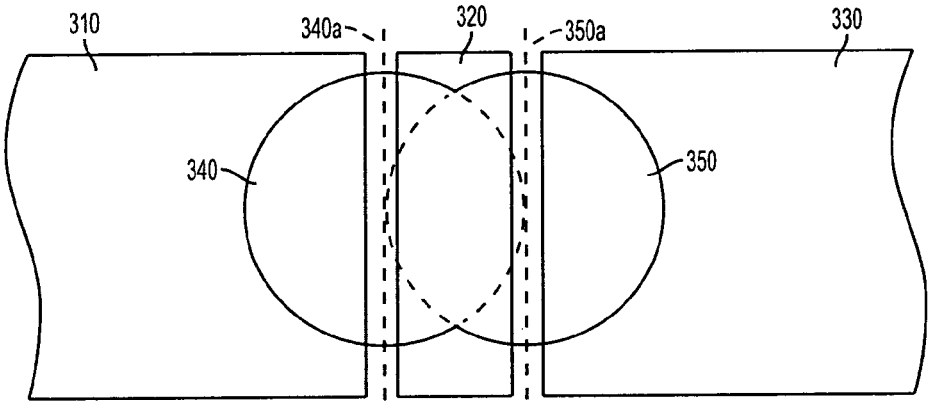

In any case, as shown in FIG. 3B, the electrostatic field caused by the voltage potential across each gap accelerates its respective droplet toward the other at the same time with the result that the first droplet 340 and second droplet 350 collide and merge. FIG. 3B illustrates droplets 340 and 350, having collided, but not yet fully merged into a combined drop. What is to be appreciated with regard to FIG. 3B is that movement of droplets 340 and 350 are at an acceleration which causes the combined drop to have a certain equilibrium at a symmetric position between gaps 360 and 370. This positioning may be understood to occur during a non-overshoot operation.

In addition to the droplets colliding and successfully merging, it has been observed that droplets will actually overshoot their equilibrium position when voltage pulses above certain thresholds are applied across the gaps. The existing single capacitor electrostatic drop merger design, as described in U.S. application Ser. No. 10/115,336, filed Apr. 1, 2002, and titled "Apparatus and Method for Using Electrostatic Force to Cause Fluid Movement", posited that the electrostatic force caused the asymmetrically-placed droplet to move from an initial asymmetric position across the gap to a position of equilibrium in which the droplet was centered across the gap. If the droplet attempted to move further, a restoring force would try to push the drop back to the centered position, thus limiting the movement to the equilibrium position. It also posited that if the momentum of the droplet was large enough, the restoring force may not be large enough to prevent the droplet from moving a greater distance off or moving completely off the originating electrode. This concept is shown in one embodiment in FIG. 3C, where droplets 340 and 350 are moved to a greater degree off of the originating electrodes 310 and 330, causing a more aggressive intermixing between the droplets 340 and 350 as compared to FIG. 3B. It is to be appreciated that in the embodiment shown in FIG. 3C, the drops have not yet completely merged. When the overshoot value is large enough, they may completely overshoot the originating electrodes and the drop will be formed completely on the middle electrode 320. However, as varying degrees of overshoot are possible in some embodiments, portions of the new drop formed by droplets 340 and 350 lie over the gaps 360 and 370 onto electrodes 310 and 330, respectively. In either case, as can be shown in FIG. 3C, the centerlines 340*a* and 350*a* have moved a much greater distance than the centerlines 340*a* and 350*a* in FIG. 3A.

By examining high speed videos taken in the laboratory environment, it has been observed the droplets may overshoot their equilibrium position. This overshoot results in oscillations of the collided droplet that occur for a period of time after the droplets collide with each other, and that continue until the surface tension of the droplet reigns in the oscillations. These oscillations create increased agitation (beyond simple diffusion) within the collided droplet that enhances mixing for from about 15 milliseconds to 20 milliseconds following collision of the two droplets.

Figure 3C:
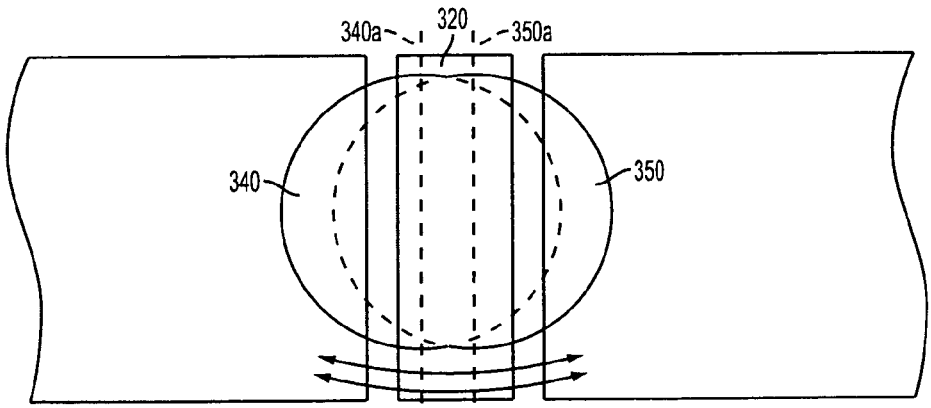
Figure 4A:
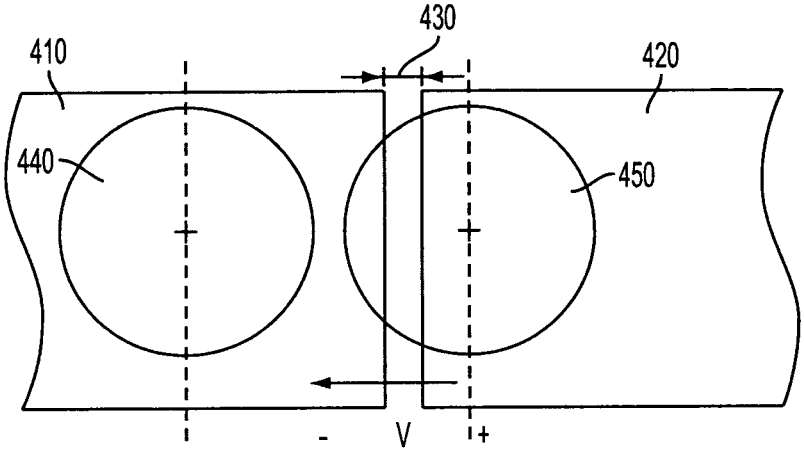
FIGS. 4A-4C illustrate dual drop movement according to another exemplary embodiment of the present disclosure.
Figure 4B:
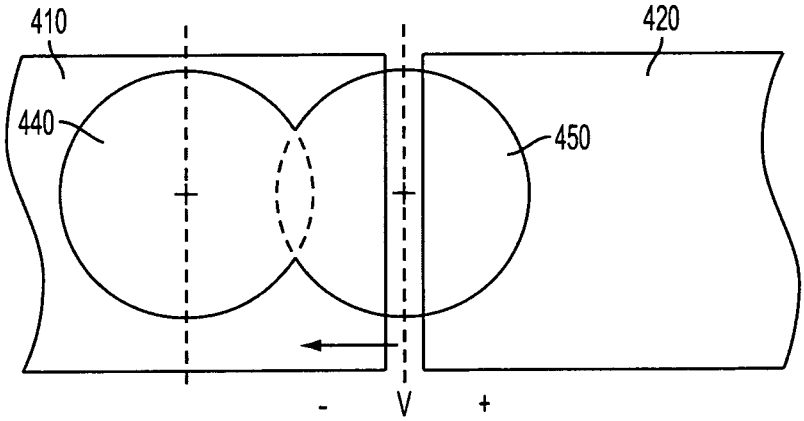
Figure 4C:
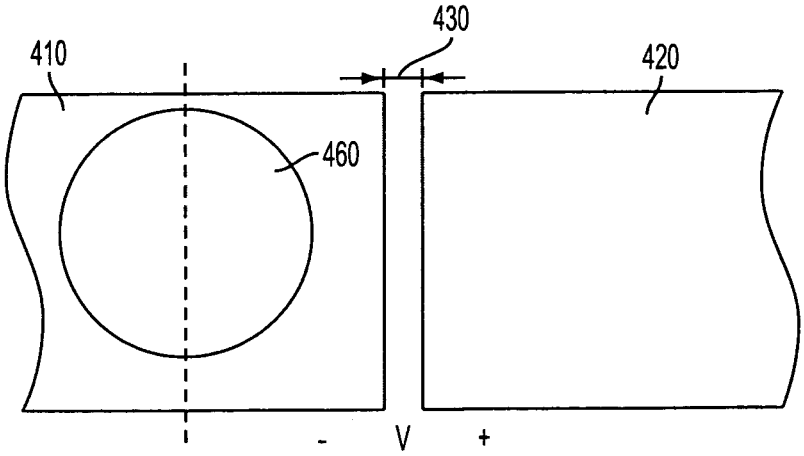
Figure 5A:
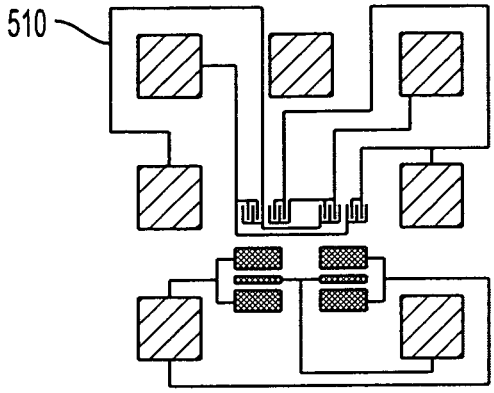
FIGS. 5A-5E show various experimental dual mode electrode layouts of the dual drop merger structure depicted in FIGS. 1A and 1B according to one exemplary embodiment of the present invention.
Figure 5B:
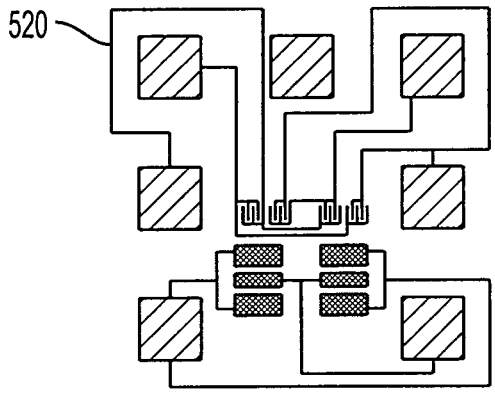
Figure 5C:
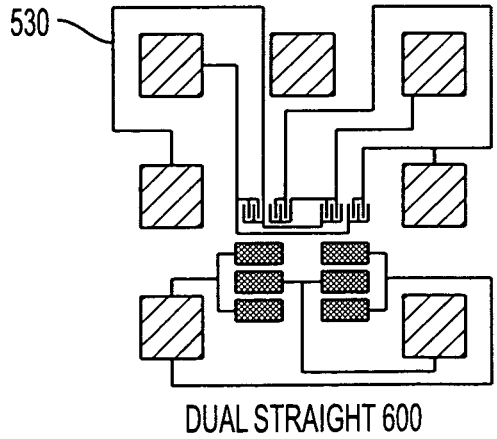
Figure 5D:
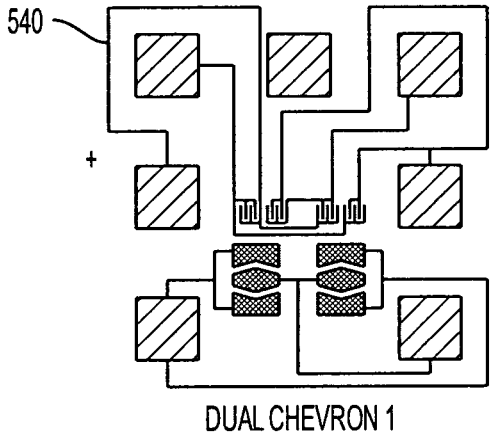
Figure 5E:
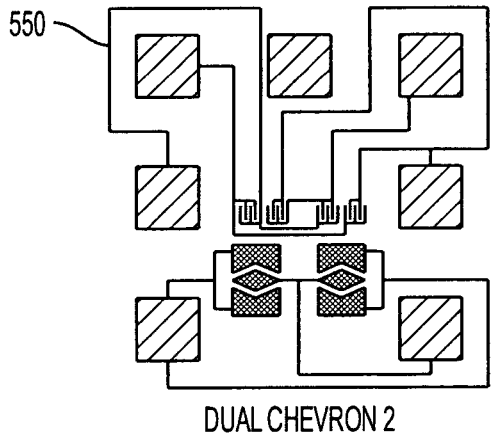

Additionally, it has been observed that this oscillation can also be made to occur in the existing single capacitor design in which a droplet moves and merges with a second, stationary, droplet, as shown in FIGS. 4A-4C. The increased agitation resulting from the oscillation of the collided droplet limits the need for additional steps, e.g. stirring the droplet with traveling waves, that are typically necessary to enhance mixing following the merger of the droplet. As illustrated in FIG. 4A, electrodes 410 and 420 are positioned in proximity to each other to form a gap 430. A first droplet 440 is positioned completely on electrode 410 and a second droplet 450 is positioned such that the majority of the droplet 450 is positioned on electrode 420. However, a portion extends over gap 430 onto electrode 410. Upon application of a potential between the electrodes above a threshold overshoot voltage value, droplet 450 moves into contact with stationary droplet 440 as shown in FIG. 4B. Due to the acceleration with which moving droplet 450 is actuated, droplet 450 moves into droplet 440 to form merged drop 460 located entirely on electrode 410 (FIG. 4C). It is to be understood, and as discussed in connection with FIGS. 3A-3C, the degree of overshoot may be made to vary, and an overshoot voltage can be selected, where the resulting merged drop may be across gap 430 with some of the drop on the electrode 420.

The length of the pulses and the level of voltage potential needed to create the overshoot depend on the materials used. The more the droplet material adheres to the dielectric surface, the greater the voltage necessary to cause the droplet to overshoot its equilibrium position across the gap. For droplets consisting of proteins, voltages of from about 180V to about 220V have been observed to create a desirable overshoot and enhanced mixing. For droplets of water, the voltage is lower, typically about 120V.

It should be noted that the droplet merging action is sensitive to the positioning of the droplets, in particular to the separation between the droplets. In order for the droplets to successfully merge and mix, the droplets must be initially placed sufficiently close together, but without touching, such that the electrostatic force may operate on the droplets. On the other hand, when the droplets become spaced too far apart, the electrostatic force will no longer be sufficient to move the droplets together. It has been observed experimentally that using the single capacitor, straight edge or chevron design, once the closest edges of the droplets are placed greater than about 200 to 250 micrometers apart, the droplets will not mix and merge. Therefore, the droplets in the system described in U.S. application Ser. No. 10/115,336 are placed initially within close proximity of each other in order for successful merging to occur. However, existing droplet placement equipment and techniques limit how closely droplets may be placed. As droplets are placed closer and closer, the droplets become more difficult to place, resulting in increased placement error and waste and decreasing the resulting yield.

With the dual capacitor drop merger design of the present exemplary embodiment, droplets may be successfully merged even when the closest edges of the two droplets are spaced up to about 300 micrometers apart. For a 250 nanoliter droplet, this equates to a center-to-center separation distance of about 1.1 millimeters between droplets. These limitations, in turn, affect the dimensions of the center electrode, which affects the spacing of the two droplets.

With reference to FIGS. 5A-5E, various experimental dual mode electrode layouts of the dual drop merger structure are shown. Straight rectangular electrodes were used with the center electrode width being alternatively 400, 500 and 600 micrometers, for electrode layouts 510, 520 and 530, respectively. Additionally, chevron shaped electrodes were used with the center electrode width being wider and narrower, shown as Chevron 1 (544) and Chevron 2 (550), respectively. The percent yield resulting from a nanocalorimeter measurement was calculated for each electrode design. The results are shown in Table 1 below.

TABLE 1

Merging Efficiency with Various Electrode Designs

| Type of Design | Merging Efficiency (%) |
|---|---|
| Single Chevron (Existing design) | 58 |
| Dual Straight (600 micrometers) | 100 |
| Dual Straight (500 micrometers) | 86 |
| Dual Straight (400 micrometers) | 46 |
| Dual Chevron 1 | 92 |
| Dual Chevron 2 | 92 |

As shown in Table 1, while the existing, single capacitor, chevron design provided increased tolerance for mispositioning and misalignment of the droplets, even with the chevron design, the yield was only 70% or less. This equates to 58% yield for a single nanocalorimeter measurement requiring the merging of two pairs of drops (one pair for reference, and one pair for the measurement). Once the center electrode width is reduced to approximately 400 micrometers, the droplets cannot be spaced far enough apart but still asymmetrically across the gap between electrodes for successful operation, and the yield decreases.

Figure 6A:
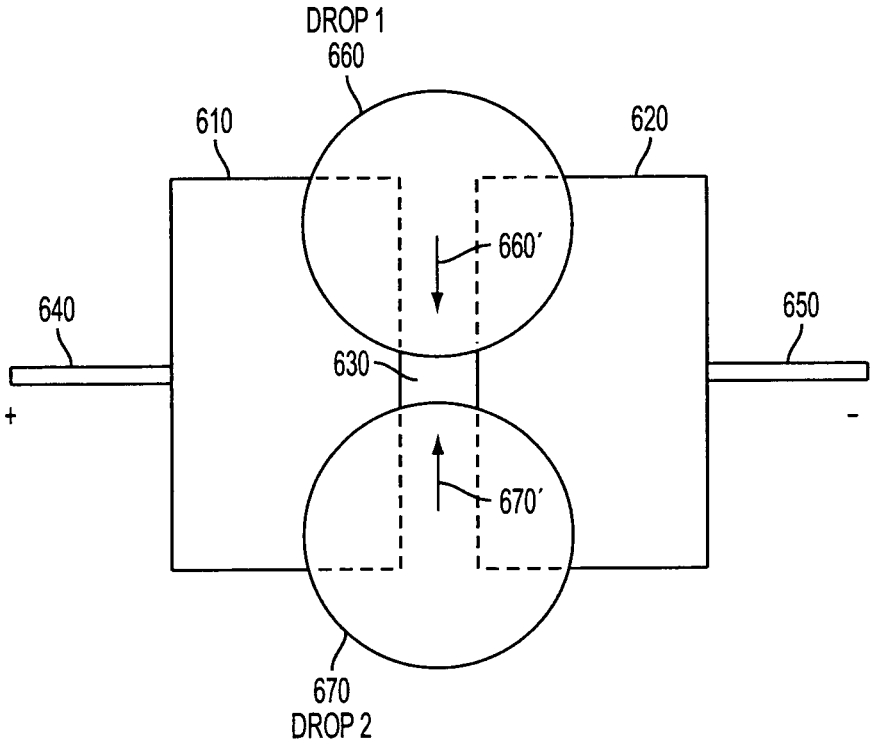
FIGS. 6A-6B depict an alternative embodiment design with an electrode gap parallel to the direction of motion of the droplets.
Figure 6B:
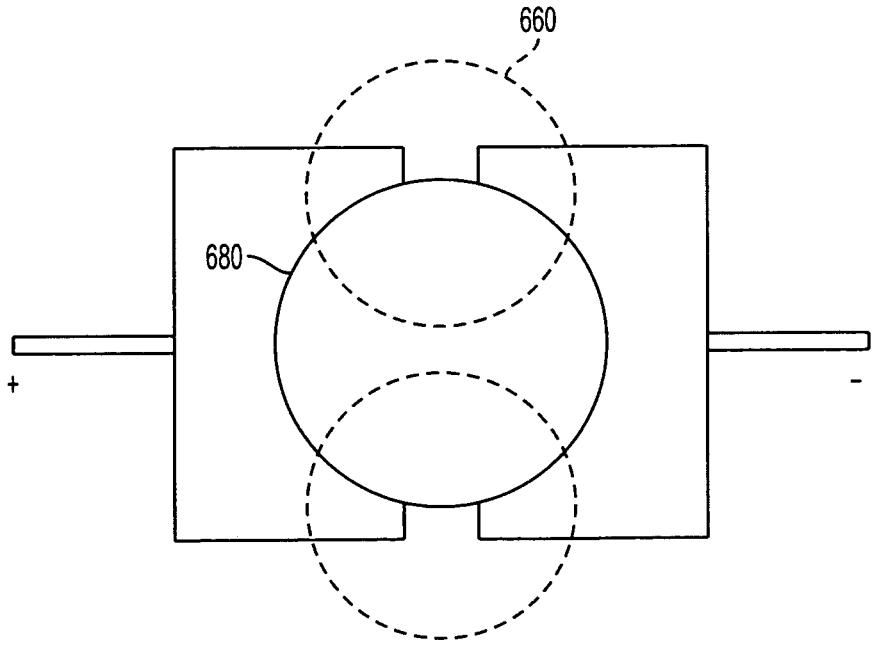

Turning to FIGS. 6A and 6B, set forth is an alternative embodiment of a dual drop merger structure designed with the electrode gap parallel to the direction of motion of the droplets. More particularly, a first electrode 610 and a second electrode 620 are positioned to create a center gap 630. In FIG. 6A, electrode 610 is supplied with a positive potential by an input power source 640, and electrode 620 is supplied with a negative potential by an input power source 650. As can be seen, and as is distinct from the previous embodiments, droplet 1 (660) and droplet 2 (670) are placed on electrodes 610 and 620, such that both extend over gap 630 and both have a portion which is located off of the electrodes 610, 620. By this placement, gap 630 is positioned parallel to an intended direction of motion of droplets 660 and 670. When electrodes 610 and 620 are energized, droplets 660, 670 both move in the direction of arrows 660' and 670' in an attempt to position the entire droplet over the electrodes 610, 620. This movement is different from the previous embodiments, as the droplets do not attempt to enter a state of equilibrium across the gap, but rather are motivated to move the entirety of the droplets onto the electrodes. By this movement, droplets 660 and 670 merge into combined droplet 680, whereby merging and mixing of the droplets 660, 670 is accomplished in combined droplet 680.

Figure 7A:
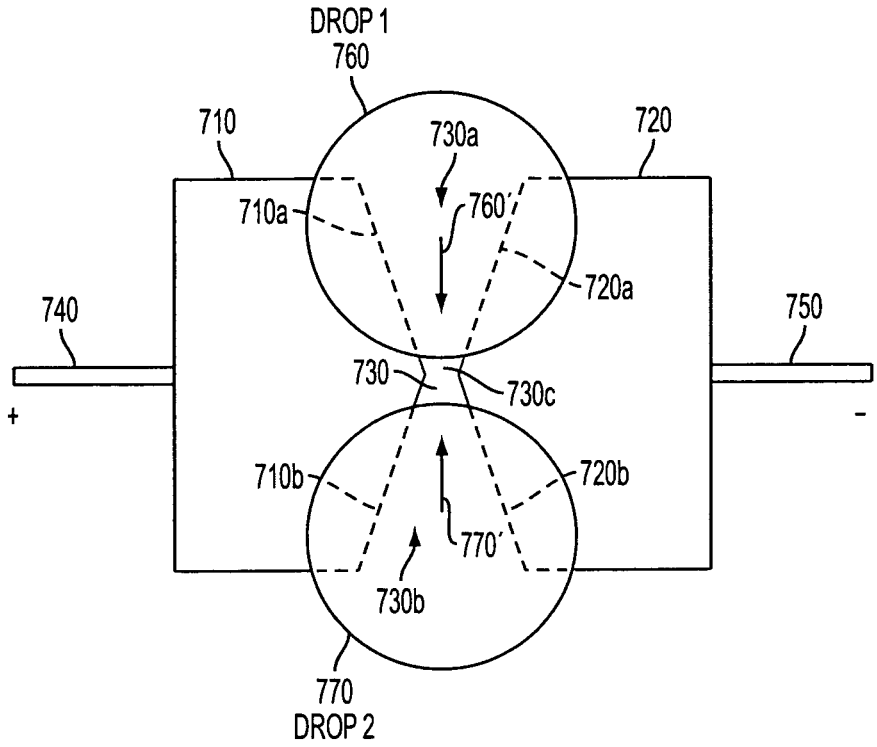
FIGS. 7A-7B depict an alternative embodiment design incorporating a profiled electrode gap as opposed to a constant-width gap of previous embodiments.
Figure 7B:
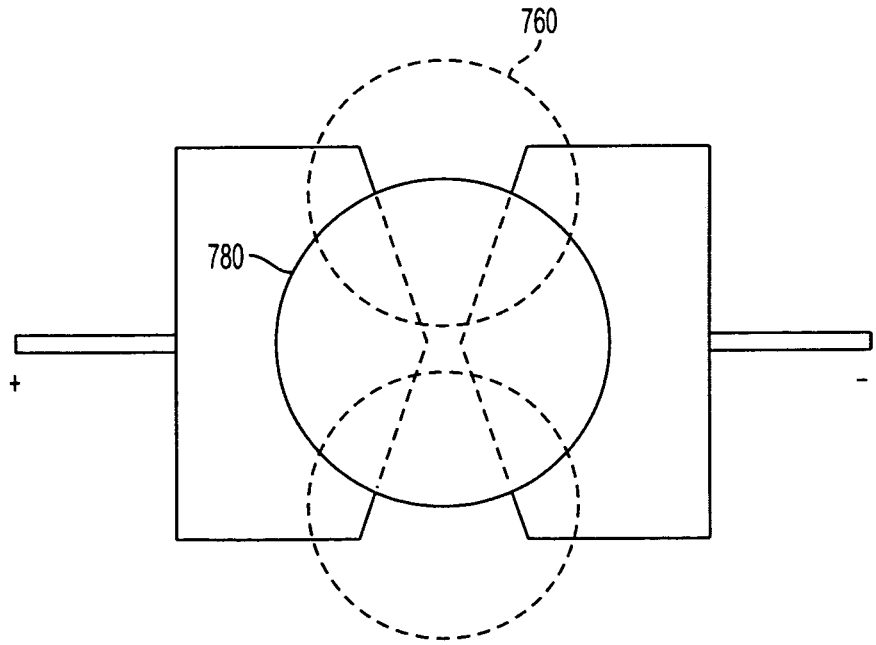

With attention to FIGS. 7A and 7B, depicted is an alternative embodiment of a drop merger structure designed with an electrode gap parallel to the direction of the motion of the droplets, similar to FIGS. 6A and 6B. However, in this design, first electrode 710 and second electrode 720 are profiled with respect to angled edges 710*a* and 710*b* for electrode 710, and angled edges 720*a* and 720*b* for electrode 720. Providing these profiled electrodes and positioning the electrodes in a desired relationship to each other forms a gap 730. As illustrated in FIG. 7A, gap 730 has wider widths 730*a*, 730*b* at the other edges of the electrode as compared to inner gap area 730*c*. This design in essence forms an "hourglass" profile.

Also provided in FIG. 7A are input power source 740 and input power source 750. As can be seen, and similar to FIGS. 6A, 6B, droplet 1 (760) and droplet 2 (770) are placed on electrodes 710 and 720, such that both extend over gap 730 and both have a portion which is located off of the electrodes 710, 720. By this placement, gap 730 is positioned parallel to the intended direction of motion of droplets 760 and 770. When electrodes 710 and 720 are energized, droplets 760 and 770 both move in the direction of arrows 760' and 770' in an attempt to position the entire droplets over electrodes 710, 720. Droplets 760 and 770 are motivated to move the entirety of the droplets onto the electrodes. By this movement, droplets 760 and 770 merge into combined droplet 780, whereby merging and mixing of the droplets 760 and 770 is accomplished in combined droplet 780.

By employing the profiled electrodes, the horizontal component of the electric field's strength will vary along gap 730 providing an energetically favorable environment for the combined droplet 780 to be maintained at the center point of the electrode gap, where the distance between the electrodes is smallest and the field strength the highest. Thus, this embodiment acts to maintain the combined drop 780 (i.e., after the merging has occurred) to a greater degree than constant-width designs. Controlling the position of the merged or combined droplets in this way is intended to provide beneficial aspects by maintaining improved symmetry between a reference and measurement sites in a nanocalorimeter device.

It is to be appreciated that while this embodiment is shown in a design where the gap is parallel to movement, profiled electrode gaps may also be used in embodiments, where movement is perpendicular to the gap, as in previous embodiments.

Additionally, while the gap profile shown in the above embodiment results in of an "hourglass" design, it is to be understood that other electrode profiles, such as curved profiles, asymmetrical profiles, irregular-polygon profiles, sawtooth profiles as well as others, may be useful.

Figure 8A:
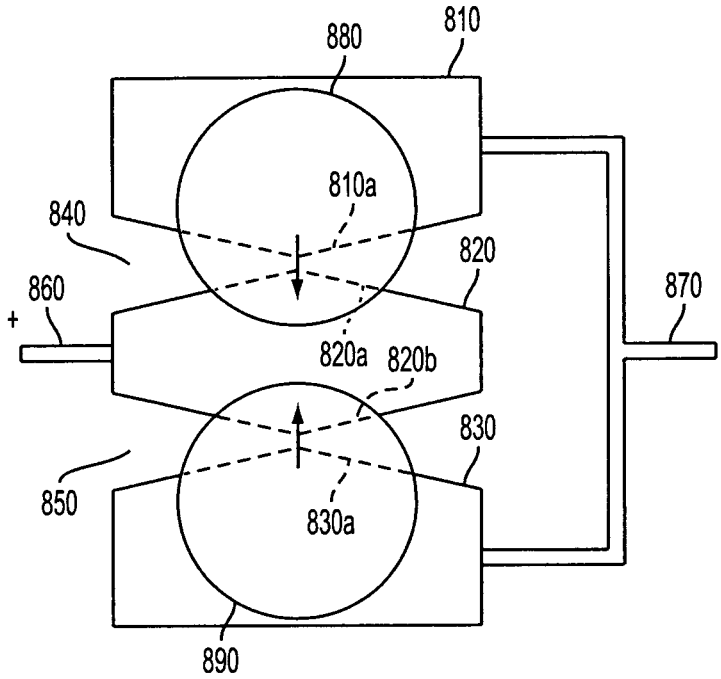
FIGS. 8A and 8B set forth a further alternative embodiment which incorporates profiled electrode gaps as opposed to constant-width gaps of the previous embodiments.
Figure 8B:
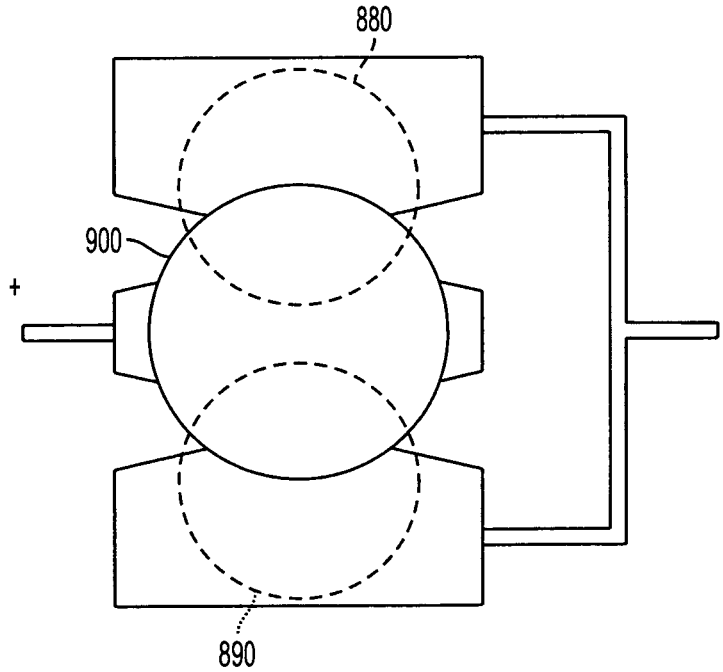

Still further, and with attention to FIGS. 8A-8B, the profiled electrode design concepts may be also used in multi-electrode merger designs discussed, for example, in FIGS. 1-3C and 5A-5E. Particularly, in the design of FIGS. 8A-8B, shown is a first originating electrode 810, a center electrode 820, and a second originating electrode 830. The first originating electrode has a first profiled surface 810*a*, the centering electrode has two profiled surfaces 820*a* and 820*b*, and second originating electrode 830 has a profiled surface 830*a*. The electrodes are arranged creating a first "hourglass" gap 840, and a second "hourglass" gap 850. Center electrode 820 is powered by input power source 860, and electrodes 810 and 830 are powered by input source 870.

Similar to the embodiments of FIGS. 3A-3C, upon energizing the electrodes, and as shown in FIG. 8B, droplets 880 and 890 move toward the center electrode 820, merging and mixing as combined droplet 900.

The beneficial aspect of profiling in this and the previous embodiments, is to provide an increased control over the x-position of the combined drop (as indicated in the figures).

Again, while the gaps shown here are designed as "hourglass" gaps, it is to be understood that the profile of the electrodes may be of other profiles, such as curved profiles, asymmetrical profiles, irregular-polygon profiles, sawtooth profiles or others, which would be within the understanding of one of ordinary skill in the art.

Figure 9:
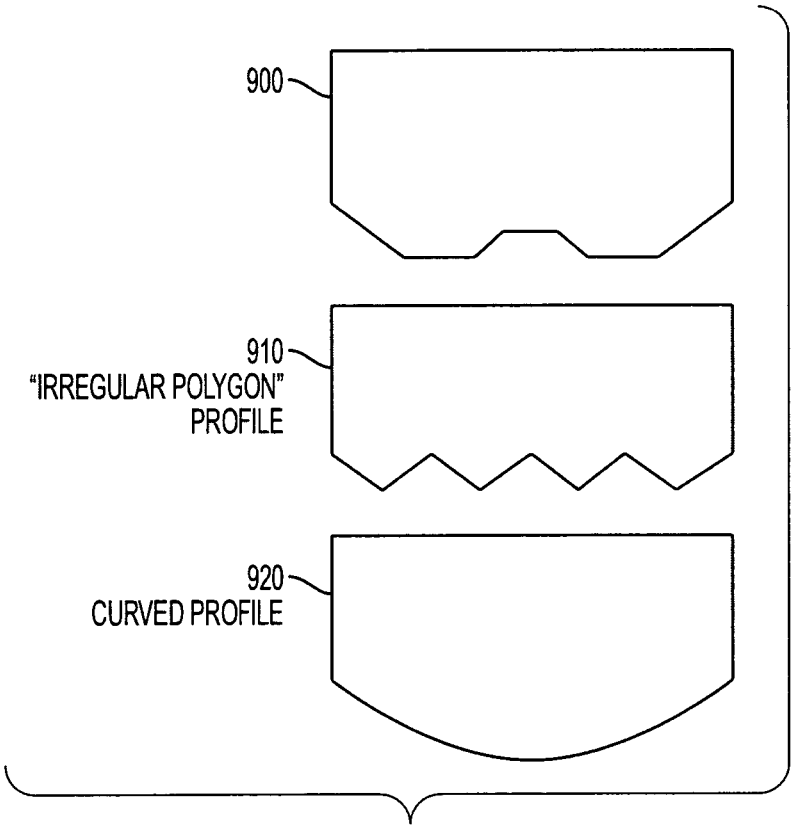
FIG. 9 illustrates a variety of electrode profiles which may be employed as merging structures.

Turning to FIG. 9, shown are examples of electrodes which may be employed in merger structures of the foregoing embodiments. These include electrodes 900, 910 having irregular polygon profiles and electrode 920 with a curved profile. It is to be appreciated these are simply example of profiles which may be used.

The method of droplet placement also affects the operation of the present embodiments. Droplets may be placed in a number of ways. They may be pushed out of a hypodermic needle manually. Manual placement allows gentle placement of the droplets, but the placement requires a long time and is not conducive to combinatorial chemistry applications, where rapid testing of large assays is desired. Alternatively, a commercial, non-contact jet dispensing system may be used. While commercial systems allow for increased speed of placement, they tend to place the droplet down with more force, resulting in the droplet compressing on the surface. This compression increases the cross-sectional contact area with the surface and thus makes placing the droplets closer together more difficult. As another alternative, a commercial dispensing system such as the Equator dispensing system from Deerac Fluidics may be used. This Equator dispensing system can produce a droplet either as a single droplet of the final desired volume or as a series of smaller volume droplets placed one on top of the other. In the laboratory, it was found that two 250 nanoliter droplets, produced by placing single droplets of 250 nanoliters directly on the substrate, cannot be placed closer than 1.3 millimeters apart because the droplets merge together during the placement of the second droplet. However, droplets made from five 50 nanoliter droplets can be placed as close as 1.0 millimeter apart without contacting each other during the deposition. Droplets formed by such procedures are seen for example in FIGS. 3A, 4A and 6A. Also, while the specific droplets forming of five 50 nanoliter droplets is mentioned, it is to be understood other combinations may also be appropriate, wherein a plurality of smaller droplets are deposited on top of each other to form a drop. Also, the foregoing discussion uses the terms drops and droplets in an interchangeable manner at certain locations in the description.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications, variations, improvements, and substantial equivalents.

The invention claimed is:

1. An apparatus for merging and mixing a first droplet and a second droplet consisting of:

a substrate;

a first originating electrode, a center electrode, and a second originating electrode, wherein each of the electrodes is disposed on the substrate such that the first originating electrode and the second originating electrode are on opposite sides of the center electrode, and wherein a first gap is formed between the first originating electrode and the center electrode, and a second gap is formed between the center electrode and the second originating electrode, the first gap having a width less than a cross-sectional diameter of the first droplet, and the second gap having a width less than a cross-sectional diameter of the second droplet; and a dielectric layer disposed adjacent to the substrate and covering the first originating electrode, the center electrode, and the second originating electrode, wherein the first originating electrode and the center electrode are positioned to receive the first droplet asymmetrically across only the first gap and resting on the first originating electrode and the center electrode and the second originating electrode and the center electrode are positioned to receive the second droplet asymmetrically across only the second gap and resting on the second originating electrode and the center electrode, and wherein a first voltage potential electrode is positioned and connected to the center electrode to apply a first voltage potential, and a second voltage potential electrode is positioned and connected to apply a second voltage potential to the first originating electrode and the second originating electrode, such that a first gap voltage potential is provided across the first originating electrode and the center electrode simultaneous to a second gap voltage potential across the second originating electrode and the center electrode, wherein the first gap voltage potential across the first originating electrode and the center electrode operates on the first droplet and the second gap voltage potential across the second originating electrode and the center electrode operates on the second droplet, such that the first droplet and the second droplet move toward each other and collide and mix together.

2. An apparatus of claim 1 wherein the first gap voltage potential and the second gap voltage potential are different from each other.

3. An apparatus of claim 1 wherein the center electrode is at least 400 micrometers in width.

4. An apparatus of claim 1 wherein at least one of the first originating electrode, the center electrode, and the second originating electrode are rectangular.

5. An apparatus of claim 1 wherein at least one of the first originating electrode, the center electrode, and the second originating electrode are of a chevron design.

6. An apparatus of claim 1, wherein at least one of the first originating electrode, the center electrode and the second originating electrode are of an irregular polygon profile design.

7. An apparatus of claim 1, wherein at least one of the first originating electrode, the center electrode, and the second electrode are of a curved profile design.

8. An apparatus of claim 1 further comprising a surface coating deposited on the dielectric layer, the surface coating facilitating the merging and mixing of the first droplet and the second droplet.

9. An apparatus for merging and mixing a first associated droplet and a second associated droplet, comprising:

a substrate;

an electrode arrangement carried on the substrate, the electrode arrangement consisting of:

a first originating electrode disposed on the substrate, a second originating electrode disposed on the substrate, a center electrode disposed on the substrate between the first and the second originating electrodes, a first gap formed between the first originating electrode and the center electrode, and a second gap formed between the second originating electrode and the center electrode;

a first voltage potential electrode connected to the center electrode;

a second voltage potential electrode connected to both the first originating electrode and the second originating electrode; and a dielectric layer disposed adjacent to the substrate and covering the first originating electrode, the center electrode, and the second originating electrode, wherein the first gap is sized to receive the first associated droplet asymmetrically across only the first gap and the second gap is sized to receive second associated droplet asymmetrically across only the second gap, and the first associated droplet and the second associated droplet are spaced apart such that they move toward each other, collide and mix only when the first voltage potential electrode has a first voltage potential applied, and the second voltage potential electrode has a second voltage potential applied, and a first gap voltage potential is applied across the first gap and a second gap potential is applied across the second gap.

10. An apparatus of claim 9 wherein a width of the first gap is less than a cross-sectional diameter of the first associated droplet and a width of the second gap is less than a cross-sectional diameter of the second associated droplet.

11. An apparatus of claim 9 wherein the first voltage potential is positive and the second voltage potential is negative.

12. An apparatus of claim 9 wherein the first voltage potential and the second voltage potential are each between 180 V and 220 V.

13. An apparatus of claim 1 wherein the first gap voltage potential and the second gap voltage potential are different from each other.

14. An apparatus of claim 9 further including a reference region, consisting of:

a first reference originating electrode disposed on the substrate;

a second reference originating electrode disposed on the substrate;

a center reference electrode disposed on the substrate between the first reference originating electrode and the second reference originating electrode;

a first reference gap formed between the first reference originating electrode and the center reference electrode; and, a second reference gap formed between the second reference originating electrode and the center reference electrode;

wherein the first voltage potential electrode is connected to the center reference electrode and the second voltage potential electrode is connected to the first reference originating electrode and the second reference originating electrode.

15. An apparatus of claim 14 wherein a third associated droplet is placed asymmetrically across the first reference gap and a fourth associated droplet is placed asymmetrically across the second reference gap, and the third associated droplet and the fourth associated droplet move toward each other, collide and mix when the first voltage potential electrode applies the first voltage potential across the center reference electrode and the second voltage potential electrode applies the second voltage potential across the first and the second reference originating electrodes.

16. An apparatus of claim 9 wherein the center electrode is at least 400 micrometers in width.

17. An apparatus of claim 9 wherein at least one of the first originating electrode, the center electrode, and the second originating electrode are rectangular.

18. An apparatus of claim 9 wherein at least one of the first originating electrode, the center electrode, and the second originating electrode are of a chevron design.

19. An apparatus of claim 9 wherein at least one of the first originating electrode, the center electrode and the second originating electrode are of an irregular polygon profile design.

20. An apparatus of claim 9 wherein at least one of the first originating electrode, the center electrode, and the second electrode are of a curved profile design.

21. A nanocalorimeter for merging and mixing a first associated droplet and a second associated droplet, the nanocalorimeter comprising:

a dielectric layer having a hydrophobic or an oleophobic characteristic;

a substrate adjacent the dielectric layer;

an electrode arrangement consisting of:

a first originating electrode approximately 5 mm-10 mm on each side disposed on the substrate, a second originating electrode approximately 5 mm-10 mm on each side disposed on the substrate, a center electrode having a width of approximately 400-600 micrometers disposed on the substrate between the first and the second originating electrodes, a first gap of between about 1 micrometer to about 500 micrometers formed between the first originating electrode and the center electrode, and a second gap of between about 1 micrometer to about 500 micrometers formed between the second originating electrode and the center electrode;

a first voltage potential electrode connected to the center electrode;

a second voltage potential electrode connected to both the first originating electrode and the second originating electrode;

wherein the first gap is sized to receive the first associated droplet asymmetrically across only the first gap with a larger percentage of the first associated droplet originally being on the first originating electrode and the second gap is sized to receive the second associated droplet asymmetrically across only the second gap with a larger percentage of the second associated droplet originally being on the second originating electrode, the two droplets spaced up to about 300 micrometers apart equating to a center-to-center separation distance of about 1.1 millimeters between droplets which are about 250 nanoliters each, and the first associated droplet and the second associated droplet move toward each other, collide and mix only when the first voltage potential electrode has a first voltage potential applied, and the first voltage potential is in turn applied across the center electrode and the second voltage potential electrode has a second voltage potential applied, and the second voltage potential is in turn applied across the first and the second originating electrodes.

22. An apparatus of claim 1 further including a thermal isolation layer, within which is located the first originating electrode, the central electrode, and the second originating electrode.

23. An apparatus of claim 9 further including a thermal isolation layer, within which is located the first originating electrode, the central electrode, and the second originating electrode.

* * * * *